United States Patent [19]

Spanel

[11] 3,937,158

[45] Feb. 10, 1976

[54] METHOD AND MEANS OF TUFTING

[76] Inventor: Abram N. Spanel, 344 Stockton St., Princeton, N.J. 08540

[22] Filed: May 29, 1974

[21] Appl. No.: 474,265

[52] U.S. Cl. ..... 112/79 FF; 83/100; 83/402

[51] Int. Cl.[2] ..... D05C 15/16

[58] Field of Search ..... 112/2, 79 R, 79 A, 79 FF, 112/80, 266; 83/100, 402

[56] References Cited

UNITED STATES PATENTS

| | | | |
|---|---|---|---|
| 3,220,371 | 11/1965 | Short et al. | 112/79 R X |
| 3,595,185 | 7/1971 | Shorrock | 112/79 R |
| 3,756,173 | 9/1973 | Shorrock | 112/79 FF |

*Primary Examiner*—H. Hampton Hunter

*Attorney, Agent, or Firm*—Steele & Petock

[57] ABSTRACT

Tufting apparatus utilizing pneumatic means for transporting yarn strands including a threader tube assembly capable of delivering a plurality of yarn strands through multiple passageways to, and loading same, in tufting elements which apply bit-lengths of the strands into a backing layer.

23 Claims, 8 Drawing Figures

Fig. 5
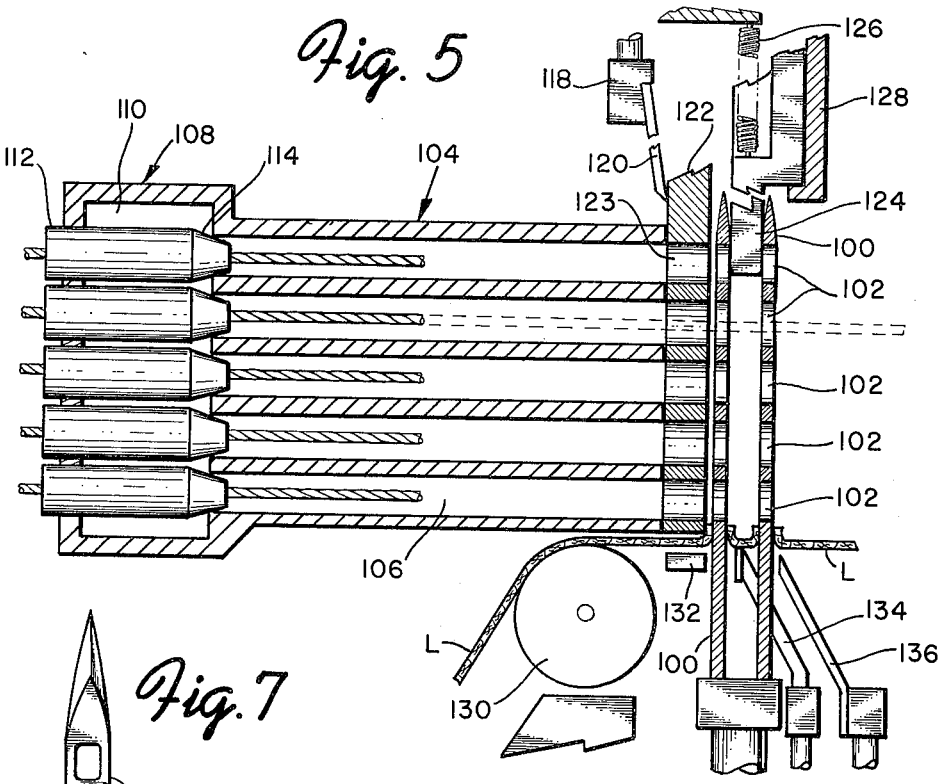
Fig. 7
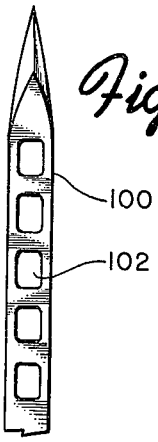
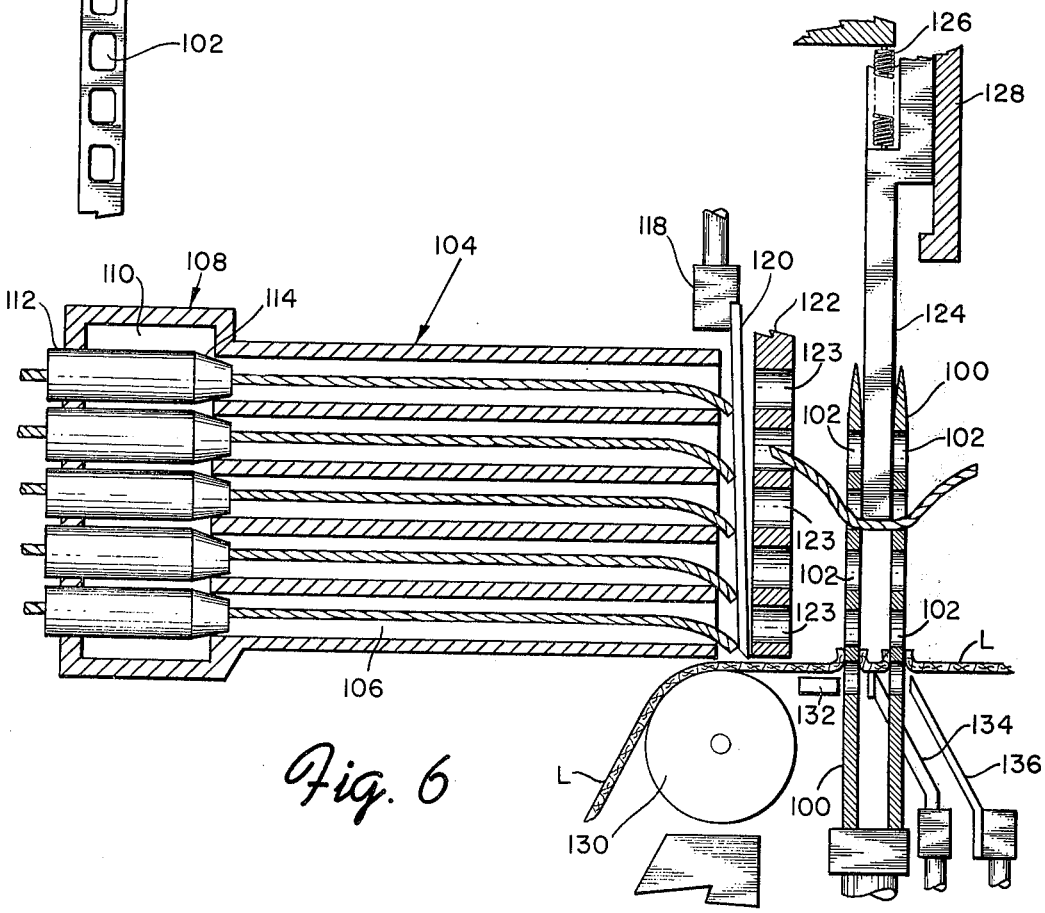
Fig. 6

METHOD AND MEANS OF TUFTING

BACKGROUND OF THE INVENTION

The subject application discloses a threader tube assembly which, while having utility in tufting systems generally, is particularly adaptable to tufting procedures of the "Spanel tufting system."

The fundamentals of the "Spanel tufting system" are disclosed in U.S. Pat. No. 3,554,147 which issued to Abram N. Spanel and George J. Brennan on Jan. 12, 1971 and U.S. Pat. No. Re. 27,165 which issued Aug. 10, 1971 to Abram N. Spanel and Lloyd E. Barton.

As disclosed in U.S. Pat. No. Re. 27,165, a pneumatic yarn transport system is disclosed wherein yarn strands and/or discrete bits of yarn are transported pneumatically to a tufting station where they are applied by tufting elements to a backing layer. Multicolor selection of the yarn bits is enabled by a shiftable magazine arrangement which provides yarn strands of various colors to each of the guide tubes through which yarn is transported to the tufting elements. For each tufting element, there is a single common guide tube passageway that extends from the magazine and through which the yarn strand or yarn bit is pneumatically fed.

The aforementioned U.S. Pat. No. 3,554,147 provides for the simultaneous selection of bit-lengths of yarn of various colors for each tufting cycle at each individual tufting station. In place of the magazine of U.S. Pat. No. Re. 27,165, U.S. Pat. No. 3,554,147 uses a collator structure in which individual channels transport yarn into a common passageway adjacent the tufting station. Each of the tufting elements has a corresponding single such common passageway leading to it through which the yarn strand is delivered prior to tufting. The capability of severing a bit-length of yarn before, during or after threading the tufting element and before or during actual tufting is provided. Since a common passageway is utilized, and since in one embodiment the severing function takes place adjacent the location of the tufting elements and after a selected yarn strand has been fed into the common passageway, a yarn pullback system is provided to remove the remaining yarn strand from the common passageway once the yarn bit has been severed therefrom.

Additionally, copending Spanel application Ser. No. 419,417 discloses improvements to the earlier Spanel disclosures in which a cutting arrangement is utilized whereby an axially reciprocable passageway section provides access for yarn severing means to sever the yarn into preselected discrete yarn bit-lengths.

Furthermore, Spanel U.S. Pat. No. 3,824,939 discloses tufting apparatus which utilizes a reciprocable threader tube having a single common passageway corresponding to each tufting needle, to place yarn in the eye of the needle and which retracts to leave the yarn deposited therein. Pneumatic means supplements the yarn transportation system.

Finally, Spanel application Ser. No. 474,264 and Ser. No. 474,266, filed concurrently with the subject application disclose additional improvements and modifications to the earlier Spanel disclosures. The first of the abovementioned applications discloses improved feeding, metering and pullback systems including improved valvable air supply means. A common passageway is, however, utilized to guide the selected yarn strand to the loading station where it is severed into a bit-length of yarn to be tufted.

With respect to Spanel application Ser. No. 474,266, various embodiments of yarn bit clamps are disclosed which may be utilized with any of the aforementioned Spanel disclosures.

In all of the above disclosures, a common passageway is used for delivering the yarn strand or bit-length of yarn to the tufting station. With such structure, it is necessary to either provide for yarn strand severing into a bit-length before the yarn enters into the common passageway or to provide for severing while in the common passageway together with withdrawal of the remaining yarn from the common passageway.

BRIEF SUMMARY OF THE INVENTION

In accordance with the subject invention, the tufting apparatus disclosed herein utilizes, in place of the common passageway of other Spanel patents, a threader tube assembly in which a plurality of tubes or passageways, are used to convey the yarn strands directly to the tufting needle stations. In one of the embodiments, the needle element utilized is the Spanel double shank needle with aligned eyes in each of the shanks. The threader tube assembly is vertically reciprocable to align a selected one of the plurality of tubes with the aligned needle eyes so that the selected yarn strand may be pneumatically transported to a loading position in the aligned needle eyes. The threader tube assembly is also axially reciprocable to provide access for knife and anvil means to sever the selected yarn strand into a discrete bit-length.

In a second embodiment, in place of the Spanel double shank needle with one eye in each shank, a double shank needle is utilized having a plurality of eyes in each shank to enable yarn from each of the tubes or passageways to be fed to a corresponding pair of the eyes. In this embodiment no reciprocation of the threader tube assembly is needed for alignment of a selected tube with the needle eyes; however, the threader tube assembly may be reciprocable to provide access for the yarn severing operation.

BRIEF DESCRIPTION OF THE DRAWINGS

FIG. 5 is a partial view of a modified threader tube assembly shown with a companion needle device;

FIG. 6 is a sectional view similar to FIG. 5 which shows a bit-length of yarn being tufted; and FIG. 7 is a partial side view showing one of the needle shanks of the needles of FIGS. 5 and 6.

DETAILED DESCRIPTION

Figure 1:
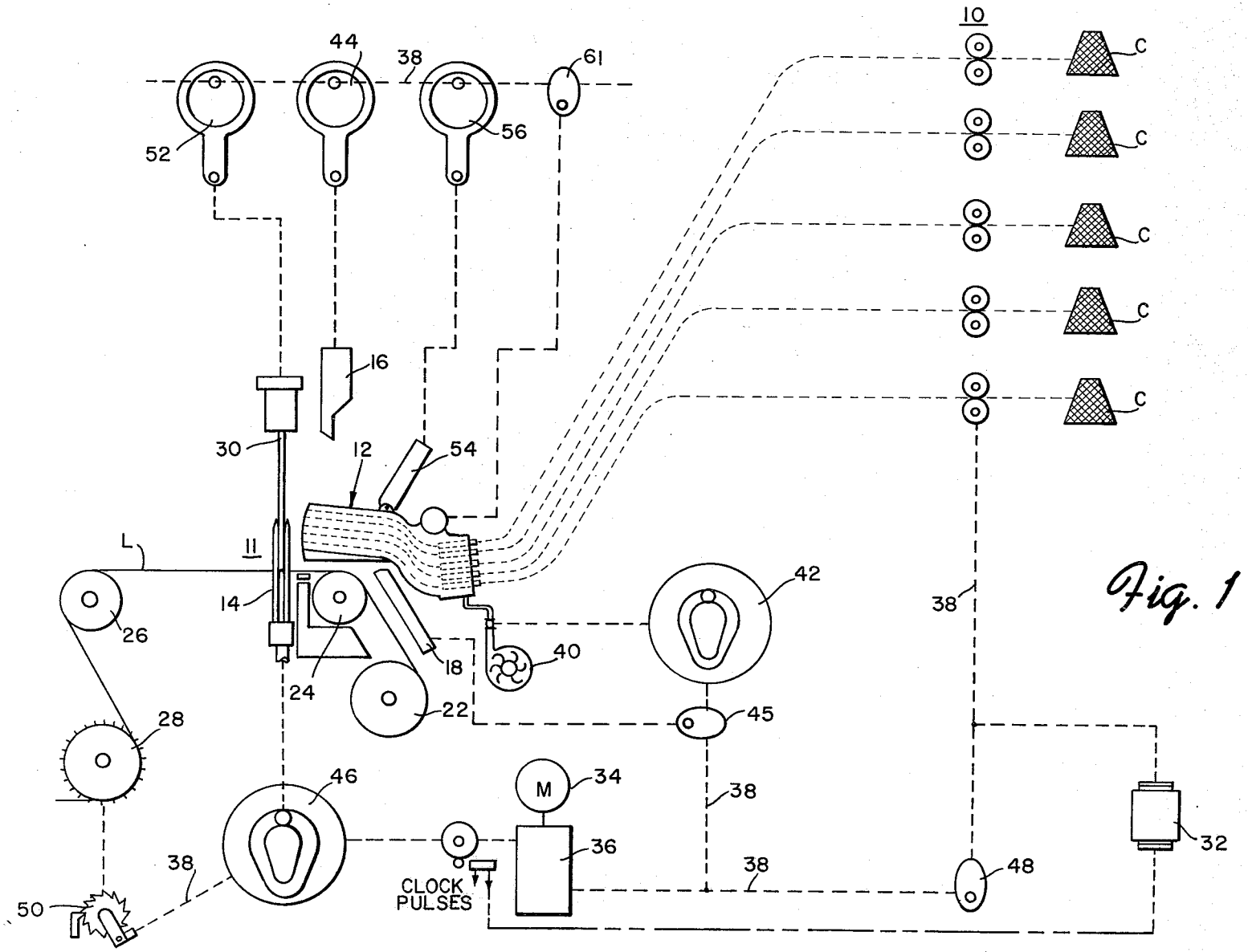
FIG. 1 is a schematic view of tufting apparatus in which the subject invention may be utilized.

The subject threader tube assembly as employed in a tufting system is shown schematically in FIG. 1. Yarn is selected and advanced from creels C by means of metering and feeding stations 10. These stations 10 may be of the type described in aforementioned copending application Ser. No. 474,264. A series of five yarns (although any practical number may be used) are shown being fed to a single needle station 11, through a threader tube assembly 12. At the needle station 11, needles or other bit-applying elements 14 are used to tuft the yarn into a backing layer L. Prior to tufting, the selected yarn strand may be severed by a knife or other yarn severing means 16 which is aligned to impact against reciprocating anvil 18 when the threader tube assembly 12 reciprocates to the right. The backing layer L is fed from feed roll 22 over backing guide 24, around idler roll 26 to the take-up roll 28. A clamping means 30 is shown which holds the yarn in a loaded position in the needles 14 until tufted.

A selection actuation means which may be a solenoid 32 or a pneumatic device or the like receives control signals for selective actuation of the metering and feeding stations 10. Patterned information such as recorded on tapes, drums or other medium is converted into electrical or other type signals as shown by clock pulses which are then transmitted to the solenoid selection actuation means 32.

A motor 34 is shown driving the tufting apparatus through transmission 36 which may be a train of gears or related mechanisms. A power transmission means 38 is schematically shown running throughout the device from which the various drive mechanisms operate.

A pneumatic supply source 40 is controlled by cam member 42 while the knife 16 is driven by cam member 44 and the anvil 18 is driven by cam 45. The needles 14 are driven by cam member 46 while the yarn clamp means 30 is driven by cam member 52. The yarn metering and feeding means 10 is controlled by cam member 48 and the backing take-up roll 28 is controlled by rachet and pawl means 50. The threader tube assembly 12 reciprocates axially to the right and left by means of carrier bar 60 which is driven by cam 63 while the selector bar 54, which is controlled by cam 56, causes the threader tube assembly to reciprocate vertically to provide yarn selection.

Figure 2:
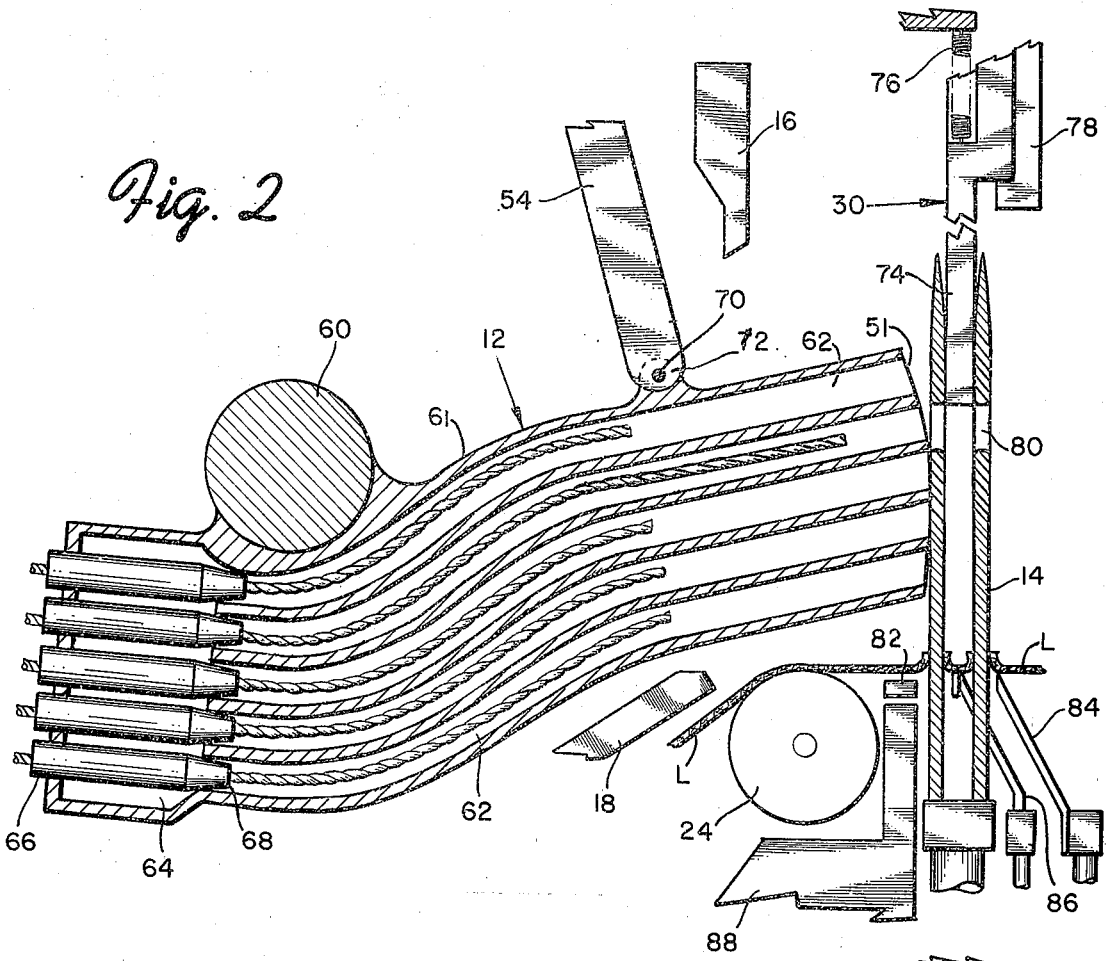
FIG. 2 is a partial sectional view showing a threader tube assembly in a selected yarn transporting position.
Figures 2A, 4:
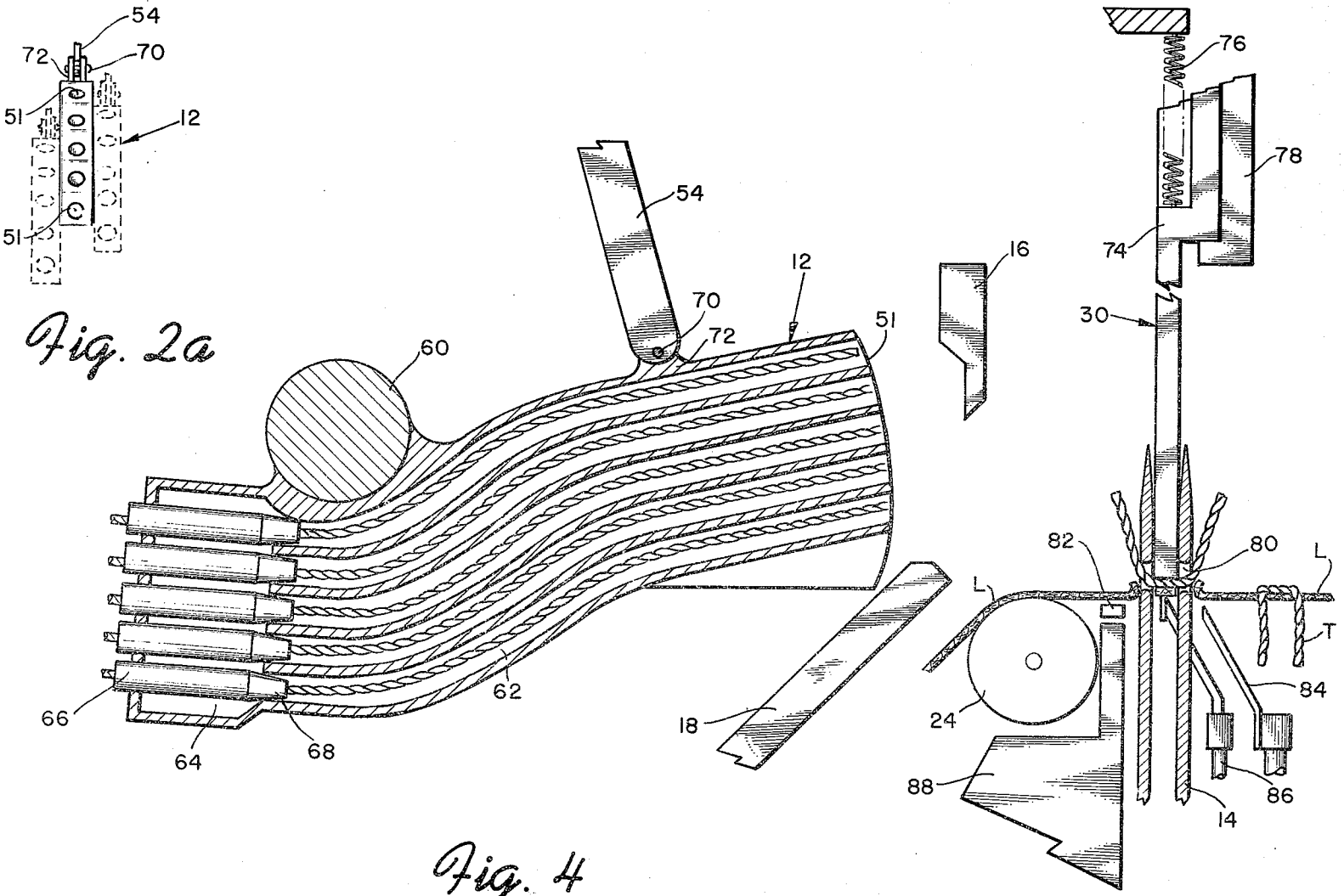
FIG. 2A is a partial end view of the threader tube assembly.
FIG. 4 is another sectional view similar to FIG. 2 which shows the bit-length of yarn being tufted.

As shown in detail in FIG. 2, each threader tube assembly 12 is pivoted on a carrier bar 60 by means of block member 61 having axial passageways 62 to accomodate the desired number of different yarn strands available for selection. The yarn strands are fed through the passageways 62 and exit at outlets 51 (see also FIG. 2A), the selected one of which is aligned with needle eyes 80. At the left of the threader tube assembly, a gas manifold 64 supplies gas to the passageways 62 to provide pneumatic transport of the yarn to the needles 14. The system may include additional pneumatic transports as disclosed in copending application Ser. No. 474,264. The yarn enters the threader tube assembly through jackets 66 and is propelled forward as the gas flows past noses 68 and through each of the threader tubes 62. As shown in FIGS. 2 and 2A, the selector bar 54 is pivotally attached by means of pivot pin 70 to the nub 72 of the carrier structure. The clamp member 30 (FIG. 2) comprises a bit clamp member 74 which is biased downwardly by compression spring 76. A lifter bar mechanism 78 may be used to unclamp bit clamp 74. The clamp member is described in more detail in copending application Ser. No. 474,266.

Also shown in FIG. 2 is tuft tucker member 82 which acts in concert with tuft retaining bar 84 to remove and hold implanted tufts free from the path of succeeding needle strokes. A stripper 86 supports the backing layer L between the needle shanks as shown. A portion of the tufting machine overall frame 88 is shown below tuft tucker member 82.

FIG. 2 also is the first of three sequential views showing the threader tube assembly 12 in its various stages of operation. As seen in FIG. 2, the knife 16 is in a raised position and the reciprocating anvil 18 is below threader tube assembly 12. The lifter bar mechanism 78 is lifting the bit clamp 74 to a raised position against the downward bias of compression spring 76. The needles 14 are at their load position and the stripper 86 and tuft retaining bar 84 also are at their load positions.

Further, as shown in FIG. 2, threader tube assembly 12 has been raised by selector bar 54 to align the yarn strand (shown extended) which is in the next to top passageway with the needle eye 80. At this time the selected yarn strand is released from its standby position by the yarn metering and feeding means 10 (see FIG. 1). The pneumatic transport advances the selected yarn strand towards its load position while the other yarn strands remain in their standby positions.

Figure 3:
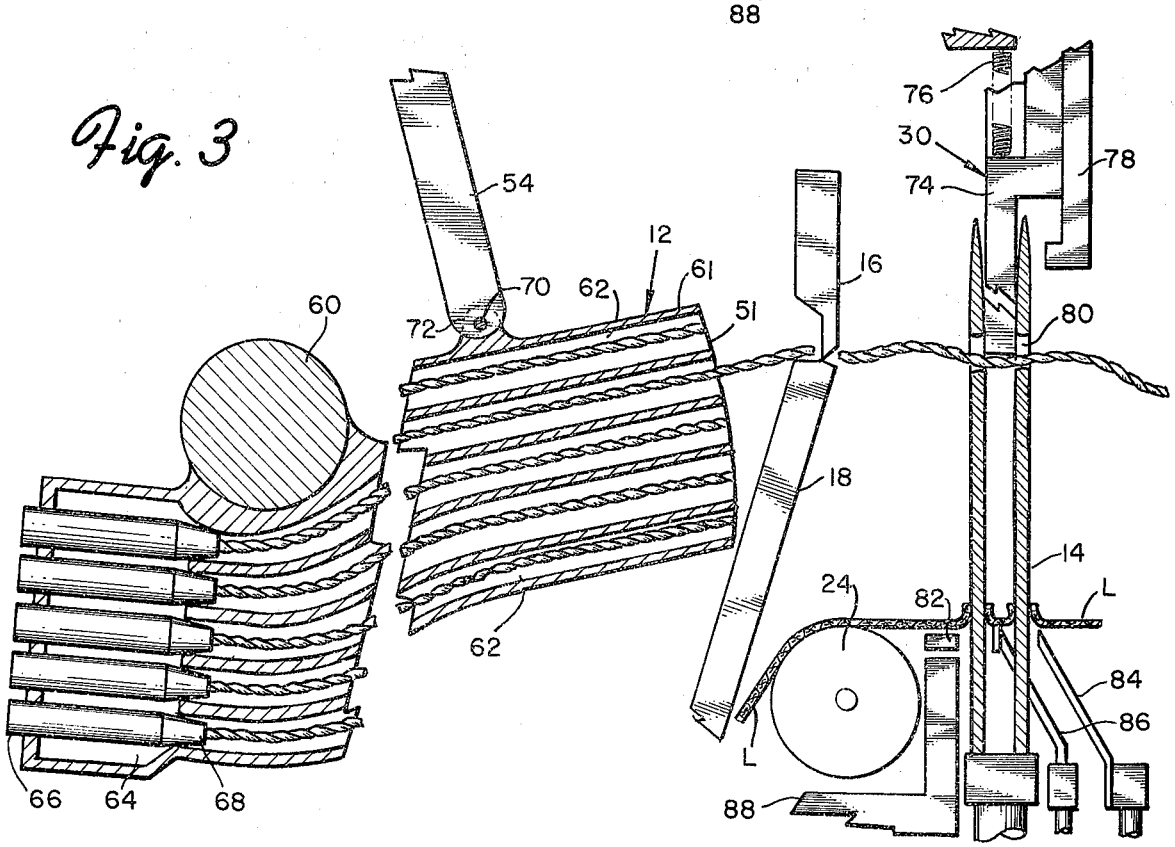
FIG. 3 is a sectional view similar to FIG. 2 which shows the severing step.

As shown in FIG. 3, the next sequential drawing, once the selected yarn strand reaches its fully extended load position, the lifter bar mechanism 78 descends permitting the bit clamp 74 to be urged downwardly by spring 76 until it clamps the yarn against the lower side of needle eyes 80. The carrier bar 60 with threader tube assembly 12 retracts to the left to clear the way for knife 16 to descend to sever the yarn on anvil 18 which has been moved to its severing position. If the particular bit-length of yarn which has been severed is not to be duplicated in the next tuft, the selector feed units start pullback to return the yarn strand to the standby position corresponding to that of the other yarn strands. A pullback system which eliminates deformation, such as described in copending application Ser. No. 474,264 may be used.

It will be recognized that in a slightly modified embodiment, the severing function in FIG. 3 can be performed close to the exit surface of outlet 51, thus eliminating the need of the pullback function.

With further reference to FIG. 3, once the yarn has been severed, the needles start their downward descent to implant the yarn bit-length in the backing layer L.

With reference now to the last sequential drawing of this sequence, FIG. 4, the needles 14 are continuing their downward descent just prior to implantation of the bit-length of yarn while the bit clamp 74 is urged by the compression spring 76 as it follows the needle 14 to the point where the yarn bit-length is clamped against the backing layer L.

As further seen in FIG. 4, the knife 16 moves upwardly and the anvil 18 descends downwardly away from threader tube assembly 12. The yarn strand from which the selected bit-length was severed has been pulled back to its standby position preparatory to the selection of the next yarn strand. Also, it will be visualized that as the needle 14 continues its downward descent, the yarn bit-length will be implanted in the backing layer L to form a U-shaped tuft T. The stripper 86 and tuft retainer 84 then descend, tuft tucker 82 moves to the right to push the legs of the last yarn bit-length to the right of the tuft retaining member 84, which then moves up to restrain the last bit-length, thus preventing its interference with the next tuft implantation.

The selector bar 54 then moves the threader tube assembly 12 to the next selected position, and carrier bar 60 moves threader tube assembly 12 back to the threading position, thus returning all components to their positions ready for the start of the next cycle as shown in FIG. 2.

Disclosed in FIGS. 5 and 6 is a modified embodiment utilizing a double shanked needle 100, each shank having five aligned eyes 102 (see FIG. 7 for needle eye details). The threader tube assembly 104 of this embodiment includes five passageways 106 in substantial alignment with the five needle eyes 102. As before, it is to be understood that while five needle eyes 102 and passageways 106 are shown, any desired number may be used.

Pneumatic supply system 108, having a gas manifold 110, is similar to that described in the embodiment described in FIGS. 2–4. Jackets 112 are shown extending therethrough and having nozzle noses 114 extending into passageways 106 as in the embodiment of FIGS. 2–4.

As also shown in FIG. 5, a knife carrier 118 carries knife blade 120 designed to coact against anvil member 122. The anvil member 122 may be described as a plate having openings 123 of a configuration similar to that of needle eyes 102 and the passageways 106. As in the earlier embodiment, a bit clamp member 124 is downwardly biased by compression spring 126 while lifter bar 128 lifts the clamp member 124 to a raised position during loading of the needles 100. Backing guide 130, tuft tucker 132, stripper 134 and tuft retainer 136 are similar to those described in the embodiment of FIGS. 2–4.

As shown in FIG. 5, the threader tube assembly 104 is in its load position abutting anvil 122 which is positioned close to the left shank of needle 100. Each of the threader tube passageways 106 is aligned with an opening 123 in the anvil 122 and with an eye 102 of the left and right shanks of needle 100. The yarn strands are in a standby position. The tuft tucker 132 is to the left of needle 100 while the stripper 134 and the tuft retainer 136 are in their raised positions. The bit clamp 124 is raised to its upper or load position by lifter bar 128 and the needles 100 are in their load positions.

A yarn strand is selected and advanced by the yarn metering and feeding means 10 (FIG. 1) and transported by gas from manifold 110 flowing past nozzle noses 114 and through passageway 106; in this case the second passageway from the top, as shown in phantom (FIG. 5) where it is loaded in needle 100.

As shown in FIG. 6, which illustrates the next events, the bit clamp 124 is released by lifter bar 128 and is urged by spring member 126 against the yarn, thereby clamping the yarn against needle eyes 102. The threader tube assembly 104 is retracted to the left together with the knife carrier 118 and the anvil member 122. A gap is left between the threader tube assembly 104 and the anvil member 122 which permits the knife blade 120 to descend to sever the selected yarn, thereby leaving a discrete yarn bit loaded in needle 100. As can be appreciated from the earlier embodiment shown in FIG. 4, the yarn needles 100 of FIG. 6 may now descend, with bit clamp 124 being urged by the compression spring 126 to follow the needle descent, thus continuing to clamp the yarn bit until the bit is clamped against the backing layer L by the needles 100. As in the embodiment of FIGS. 2 to 4, once the tuft is implanted, bit clamp 124 moves upward, stripper 134 and tuft retainer 136 descend, tuft tucker 132 moves to the right to urge the bit legs to the right of tuft retainer 136, and finally tuft retainer 136 moves upwardly to hold the legs of the yarn bit out of the path of succeeding tufts. During the motion of tuft tucker 132, backing layer L also moves to the right and threader tube assembly 104, knife blade 120 and anvil member 122 and needles 100 all return to their original positions preparatory to the next tufting step.

While various embodiments of the invention have been shown and described, it will understood that various modifications may be made. The appended claims, therefore, are intended to define the true scope of the invention.

I claim:

1. Tufting apparatus comprising:
bit-applying elements;
loading means for loading said bit-applying elements, said loading means including a plurality of yarn passageways through each of which may be transported a yarn strand, said loading means further including means to align each of said yarn passageways relative to said bit-applying elements;
pneumatic transporting means to transport yarn strands through said loading means to said bit-applying elements;
strand severing means to sever yarn bits from said yarn strands; and
means operable with said bit-applying elements to apply said yarn bits to a backing.

2. The apparatus of claim 1 wherein said bit-applying elements contain a plurality of eyes.

3. The apparatus of claim 1 wherein said loading means is reciprocable to align any of said passageways with said bit-applying elements.

4. The apparatus of claim 3 wherein said loading means further is reciprocable to provide access for a yarn severing means.

5. The apparatus of claim 3 wherein said loading means further comprises pneumatic yarn transport means operating with said passageways.

6. The apparatus of claim 5 wherein said pneumatic yarn transport means comprises:
a gas manifold;
yarn jackets through which said yarn travels from said manifold, into said passageways, said jackets having nozzle noses around which gas may flow from said gas manifold to said passageways.

7. The apparatus of claim 4 wherein said loading means reciprocates to provide an access opening between said loading means and said bit-applying elements and said strand severing means comprises:
a cutting means operable through said access opening to sever said yarn bits from said yarn strands.

8. The apparatus of claim 7 wherein said cutting means comprises a knife and anvil which are individually or collectively reciprocable to sever said yarn bit.

9. Tufting apparatus comprising:
bit-applying elements containing a plurality of eyes;
loading means for loading said bit-applying elements, said loading means including a plurality of yarn passageways through each of which may be transported a yarn strand to one of said plurality of eyes;
means to transport yarn strands through said loading means to said bit-applying elements;
strand severing means to sever yarn bits from said yarn strands; and
means operable with said bit-applying elements to apply said yarn bits to a backing.

10. The apparatus of claim 9 wherein said strand severing means comprises a knife and a mating surface.

11. The apparatus of claim 10 wherein said mating surface comprises a member having openings which are aligned with said passageways of said loading means and with said plurality of needle eyes.

12. The apparatus of claim 11 wherein said knife is positioned adjacent said mating surface and severs said yarn by relative movement of said knife and said mating surface.

13. The apparatus of claim 12 wherein said loading means shifts away from said mating surface to provide access for said knife to sever said yarn strands.

14. The tufting apparatus of claim 1 further including clamping means to secure yarn in said bit-applying element.

15. The apparatus of claim 14 wherein said yarn clamping means clamps said yarn against said backing until said bit-applying elements secure yarn in the backing.

16. The apparatus of claim 15 further including a stripper member which supports said backing.

17. The apparatus of claim 1 further including a tuft tucker shiftable to move tuft legs away from position when deposited; and a reciprocable tuft retainer which moves in timed relationship with said tuft tucker to retain said tuft legs in a position of non-interference with the succeeding tuft.

18. Tufting apparatus comprising:

tufting needles including a plurality of yarn receiving eyes;

threader tube assembly means including yarn passageways through each of which may be transported a yarn strand, said threader tube assembly means being operable to align each of said yarn strands with one of said needle eyes, said threader tube assembly means further comprising pneumatic transport means by which said yarn strands are transported through said threader tube assembly;

strand severing means to sever yarn bits from said yarn strands; and means operable with said tufting needles to attach yarn bits to a backing.

19. Tufting apparatus comprising:

bit-applying elements, including yarn receiving means;

loading means for loading said bit-applying elements, said loading means including multiple yarn passageways, said loading means being operable to align yarn strands extending therethrough with said yarn receiving means of said bit-applying elements, each of said passageways being alignable to communicate directly with said yarn receiving means;

pneumatic transport means to transport yarn strands through said loading means to said bit-applying elements;

strand-severing means to sever yarn bits from said yarn strands; and means operable to move said bit-applying elements whereby yarn bits are placed in tufting relationship with a backing.

20. A tufting machine for forming tufts with respect to a backing comprising:

tufting-needle means reciprocable between a threading position and a tufting position;

threader tube assembly means for each tufting needle means, each threader tube assembly means including a plurality of yarn passageways through each of which may be transported a yarn strand;

mechanism for reciprocating said threader tube assembly means relative to said needle means;

pneumatic means associated with said threader tube assembly means for transporting yarn strands via said threader tube assembly means into said tufting-needle means when in said threading position;

control means for said threader tube assembly means to select a desired passageway through which to transport a yarn strand into said tufting needle means;

strand severing means;

means operating said strand severing means to sever said yarn strands; and means for reciprocating said tufting-needle means for applying said severed yarn strands to the backing to form tufts.

21. The tufting machine of claim 20 further comprising means for metering and feeding a selected yarn strand through a selected passageway.

22. In a tufting machine having needle means, pneumatic means to transport strands of yarn, a threader tube assembly means, including a plurality of yarn passageways for threading said needle means, and severing means for severing yarn into severed yarn lengths, the method of applying tufts to a backing comprising the steps of:

positioning said needle means in a loading position;

selecting a given passageway of said plurality of yarn passageways and aligning said passageway with yarn receiving means of said needle means;

pneumatically feeding yarn through said passageway;

shifting said threader tube to provide access to the yarn for severing;

severing said tufting yarn; and depositing said severed length of yarn in said backing to form a tuft.

23. In a tufting machine having needle means including yarn receiving means, pneumatic means to transport strands of yarn, a threader tube assembly having a plurality of passageways for delivering strands of yarn to said needle means and severing means for severing yarn into severed yarn lengths, the method of applying the tufts to a backing comprising the steps of:

positioning said needle means in a loading position;

aligning one or more passageways of said plurality of passageways with the means for receiving yarn;

pneumatically transporting a selected strand of yarn through said threader tube assembly and into said needle means;

severing said selected strand of yarn to leave a severed length of yarn in said needle means; and depositing said severed length of yarn into said backing to form a tuft.

* * * * *